US008485172B2

(12) United States Patent
Tseng

(10) Patent No.: US 8,485,172 B2
(45) Date of Patent: Jul. 16, 2013

(54) PNEUMATIC FIRING DEVICE FOR A PAINT BALL GUN

(76) Inventor: Ying-Jung Tseng, New Taipei (TW)

( * ) Notice: Subject to any disclaimer, the term of this patent is extended or adjusted under 35 U.S.C. 154(b) by 270 days.

(21) Appl. No.: 13/161,517

(22) Filed: Jun. 16, 2011

(65) Prior Publication Data

US 2012/0318251 A1 Dec. 20, 2012

(51) Int. Cl.
*F41B 11/00* (2013.01)

(52) U.S. Cl.
USPC ..... 124/73

(58) Field of Classification Search
USPC ..... 124/72–77
See application file for complete search history.

(56) References Cited

U.S. PATENT DOCUMENTS

| | | | | |
|---|---|---|---|---|
| 6,601,780 | B1 * | 8/2003 | Sheng | 239/337 |
| 6,810,871 | B2 * | 11/2004 | Jones | 124/77 |
| 7,527,049 | B2 * | 5/2009 | Sheng | 124/73 |
| 7,654,256 | B2 * | 2/2010 | Huang | 124/72 |
| 7,931,018 | B1 * | 4/2011 | Lai | 124/77 |
| 2008/0011283 | A1 * | 1/2008 | Lai | 124/73 |
| 2009/0178660 | A1 * | 7/2009 | Huang | 124/73 |
| 2009/0199832 | A1 * | 8/2009 | Long | 124/73 |
| 2009/0241931 | A1 * | 10/2009 | Masse | 124/76 |
| 2010/0012109 | A1 * | 1/2010 | Lai | 124/77 |

* cited by examiner

*Primary Examiner* — Bret Hayes
*Assistant Examiner* — Reginald Tillman, Jr.

(57) ABSTRACT

A device for controlling the firing of a paint ball gun includes a shell having a muzzle, a ball inlet, and a gas inlet, forward, intermediate and rear ports, and a main line; a reciprocating member communicating with the main line; a sleeve assembly comprising forward and rearward sleeves releasably secured together, the rearward sleeve comprising peripherally arranged inlet ports, a peripheral first port communicating with the rear port, and a peripheral second port communicating with the intermediate port; a plunger slidably disposed in the forward sleeve and comprising a first peripheral space defined between the plunger and the forward sleeve; a retaining sleeve in the rearward sleeve and extending into the plunger; a sliding valve in the retaining sleeve, the sliding valve comprising a transverse passageway; a cylindrical block comprising a transverse passageway; and a hollow retaining member releasably secured to both the rearward sleeve and the block.

2 Claims, 9 Drawing Sheets

PNEUMATIC FIRING DEVICE FOR A PAINT BALL GUN

BACKGROUND OF THE INVENTION

1. Field of the Invention

The invention relates to paint ball guns and more particularly to a pneumatic firing device for a paint ball gun.

2. Description of Related Art

A paint ball gun is the main piece of equipment in the sport of paint ball. Guns use an expanding gas, such as compressed air or carbon dioxide ($CO_2$) to propel paint balls through the barrel. Paint ball guns can fire in rapid succession a relatively large number of paint balls in a short period of time. A magazine stores the paint balls until the balls are delivered to the gun firing chamber. The guns use compressed gas as the propellant, and are usually triggered by a user squeezing a conventionally shaped gun trigger. When the gun user repeatedly squeezes the trigger, the gun should continue to fire paint balls as rapidly as possible. Guns may be manually loaded before each shot, but most are either semi-automatic, where each time the trigger is pulled a paint ball is fired, or fully automatic, where the balls are fired as quickly as the gun is capable of for as long as the trigger is pulled.

Quite unlike conventional explosive-propelled munitions, paint balls are relatively round and have an exterior formed from a semi-rigid gelatinous compound. The gelatinous compound is known to be affected somewhat by such variables as temperature and relative humidity. During a firing sequence, paint balls on occasion lodge against each other or other objects and block the passageway to the firing chamber, resulting in a jam. While jamming is not new, knowledge from explosive munitions magazines is of little use with the very different paint balls.

The invention described below aims to minimize jams and provides other beneficial advantages to firing mechanism of a conventional paint ball gun.

SUMMARY OF THE INVENTION

It is therefore one object of the invention to provide a device for controlling the firing of a paint ball gun comprising a shell comprising a forward muzzle, an intermediate passage, a ball inlet on the top of the passage, a rear channel, a gas inlet on the bottom of the channel, a forward port on the bottom of the channel and being in front of the gas inlet, an intermediate port on the bottom of the channel and being rearward of the gas inlet, a rear port on the bottom of the channel, and a main line having one end connected to the forward port and the other end connected to the rear port; a reciprocating member communicating with the main line; a sleeve assembly disposed in the channel and comprising a forward sleeve and a rearward sleeve releasably secured together, the rearward sleeve comprising a plurality of peripherally arranged inlet ports, a peripheral first port communicating with the rear port, and a peripheral second port communicating with the intermediate port; a hollow, cylindrical plunger slidably disposed in the forward sleeve and comprising a first peripheral space defined between the plunger and the forward sleeve; a retaining sleeve disposed at a forward portion of the rearward sleeve and extending into the plunger, the retaining sleeve comprising a plurality of peripherally arranged rear third and fourth ports, a plurality of peripherally arranged intermediate grooves on an outer surface, an annular inclined shoulder on an intermediate portion of an inner surface, and a hollow member releasably fastened in the retaining sleeve; a cup-shaped sliding valve disposed in the retaining sleeve, the sliding valve being complimentarily engaged with the inclined shoulder, the sliding valve comprising a transverse passageway communicating its hollow interior and an outer surface; a cylindrical block comprising a forward cavity and a transverse passageway communicating the cavity and an outer surface; and a hollow retaining member releasably secured to both the rearward sleeve and the block and sandwiched therebetween.

The above and other objects, features and advantages of the invention will become apparent from the following detailed description taken with the accompanying drawings.

DETAILED DESCRIPTION OF THE INVENTION

Figure 1:
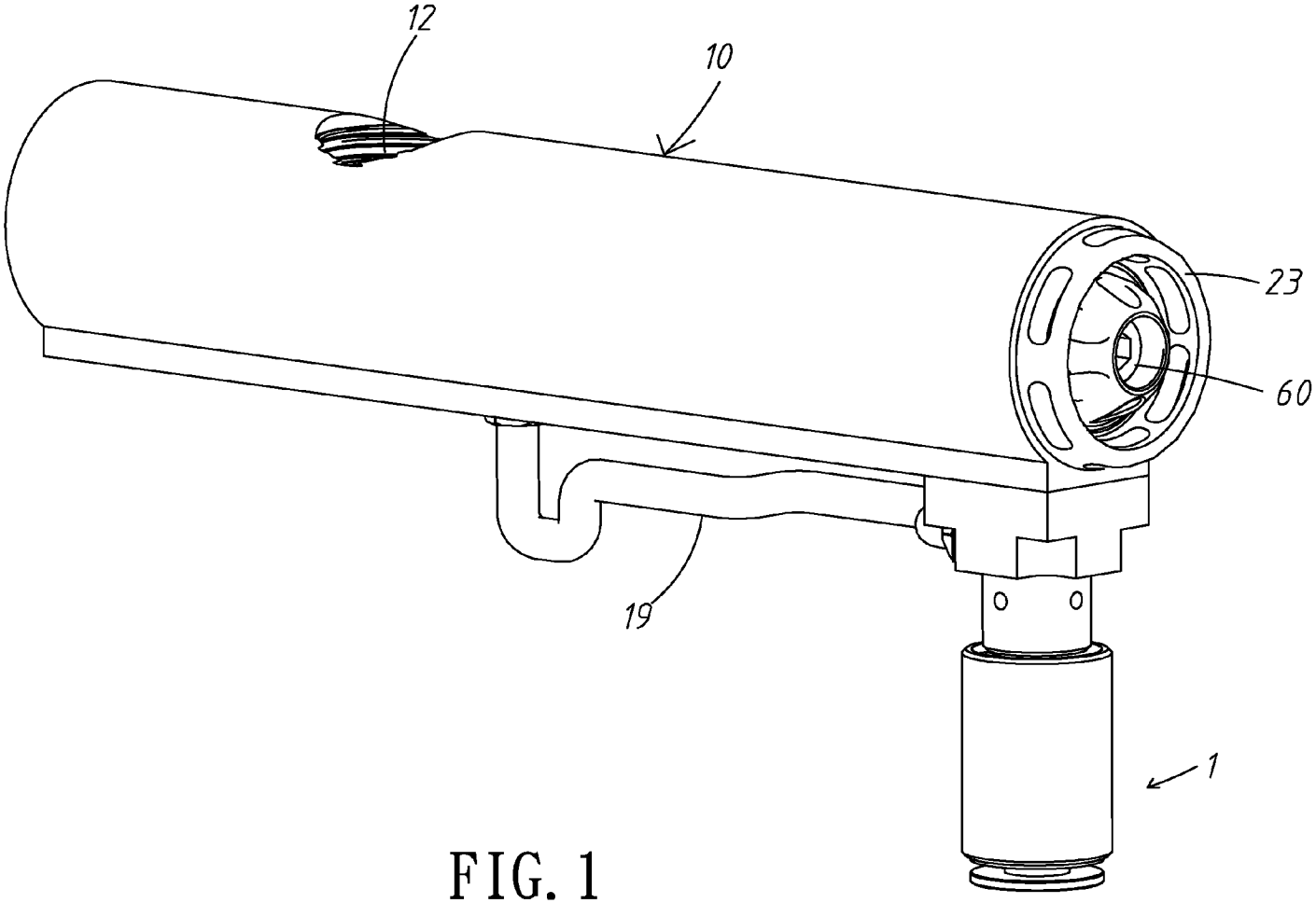
FIG. 1 is a perspective view of a paint ball gun incorporating a pneumatic firing device according to the invention.
Figure 2:
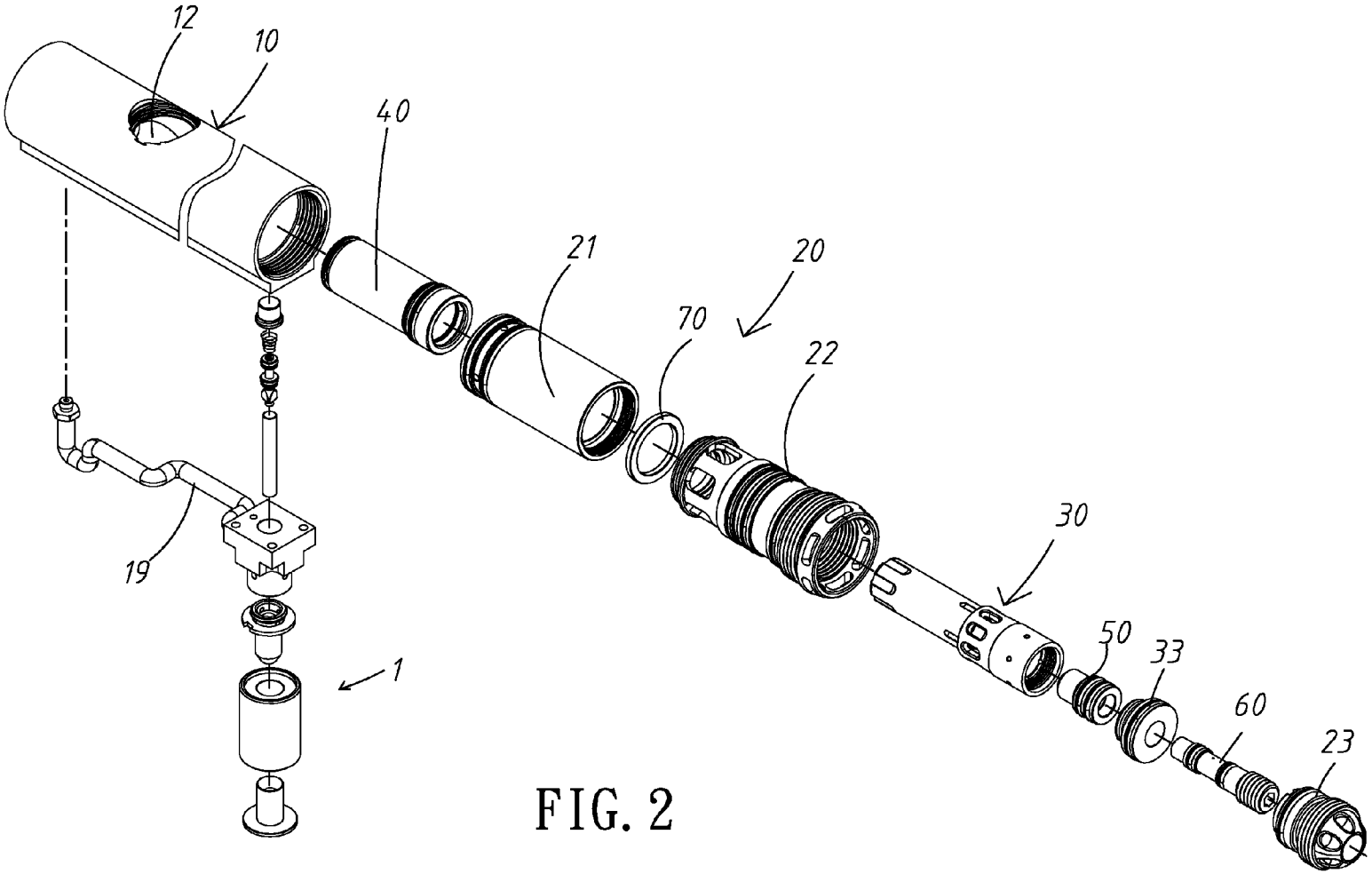
FIG. 2 is an exploded view of the paint ball gun.
Figure 3:
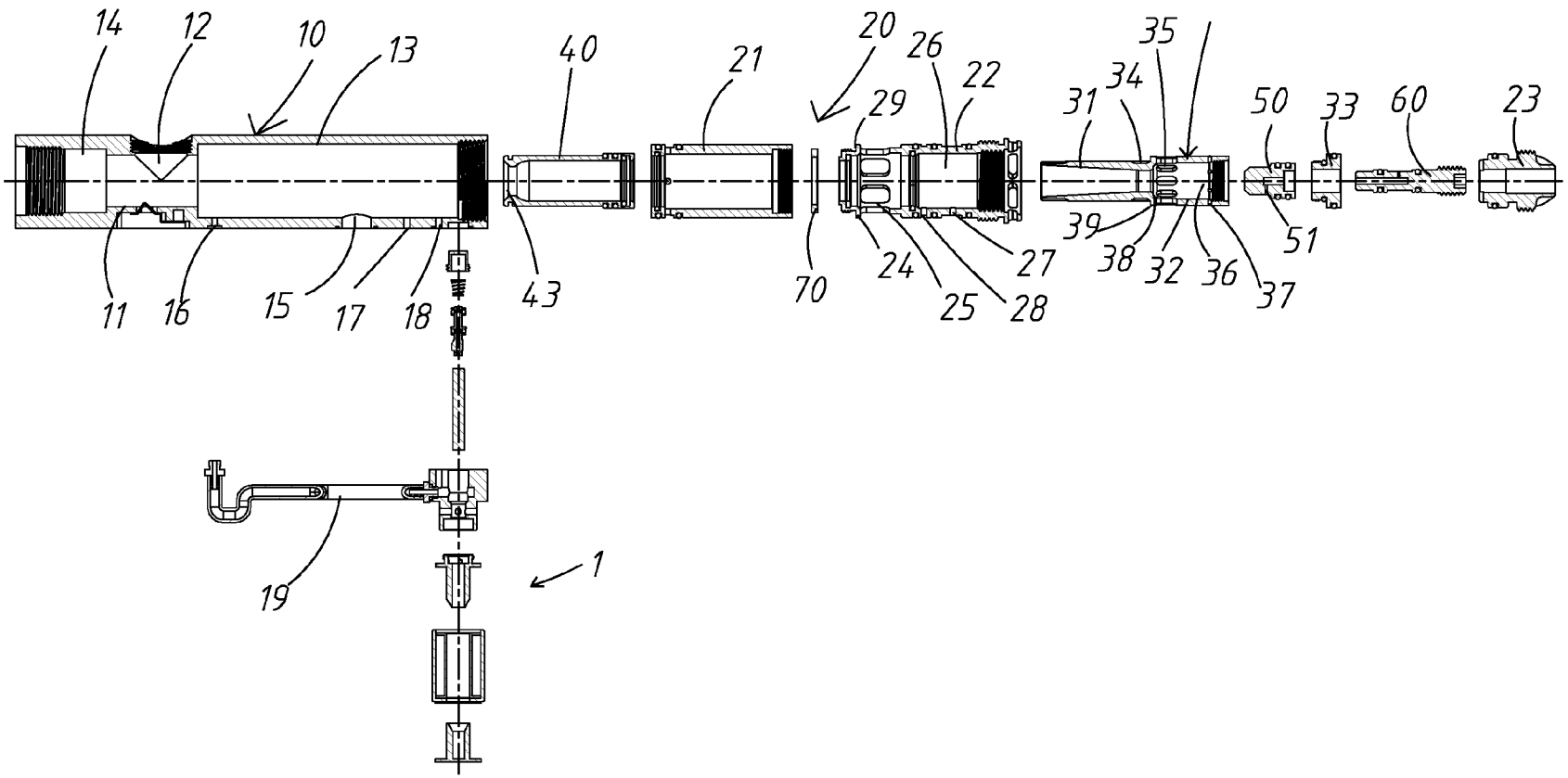
FIG. 3 is a longitudinal sectional view of FIG. 2.
Figure 4:
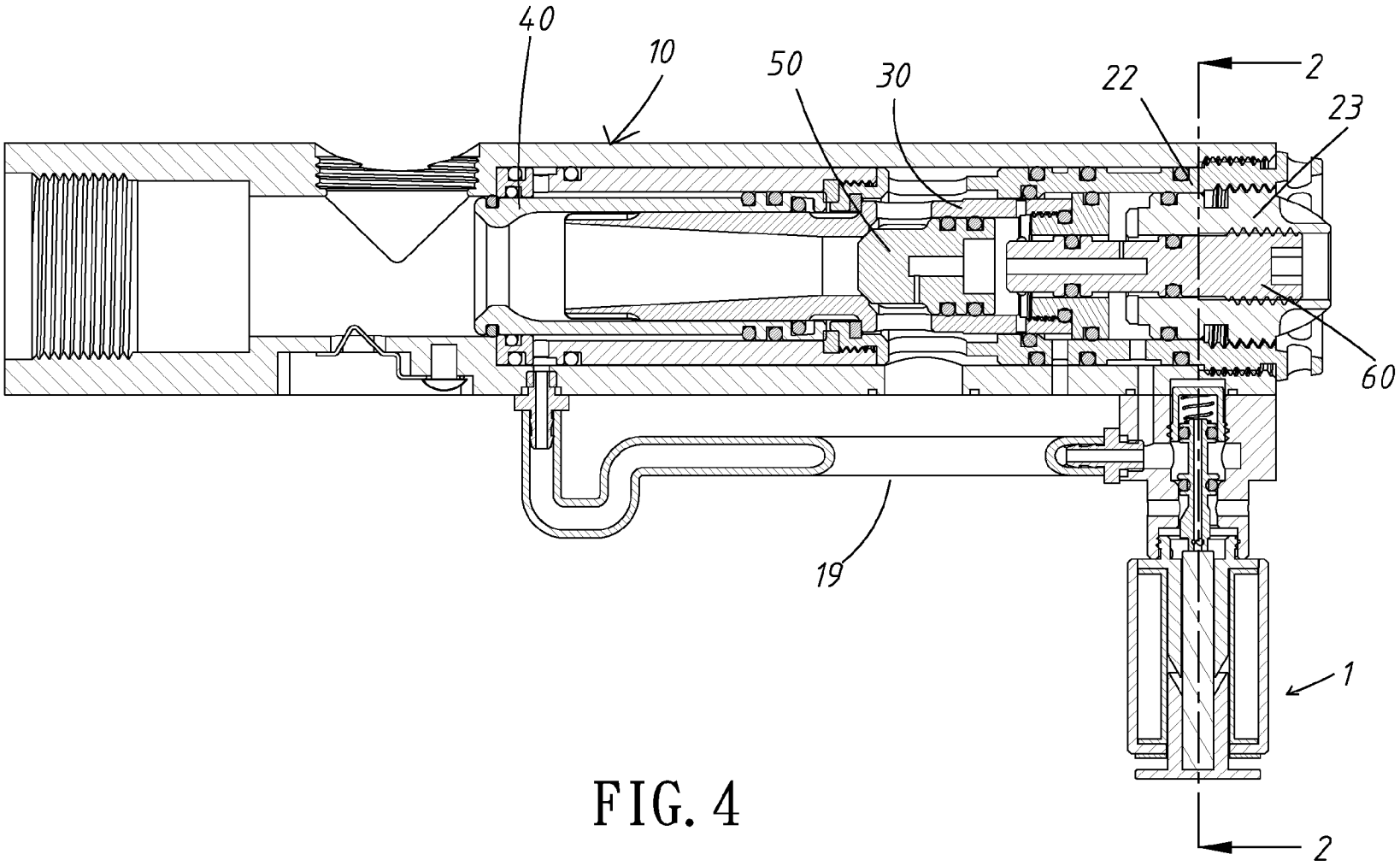
FIG. 4 is a longitudinal sectional view of FIG. 1.
Figure 5:
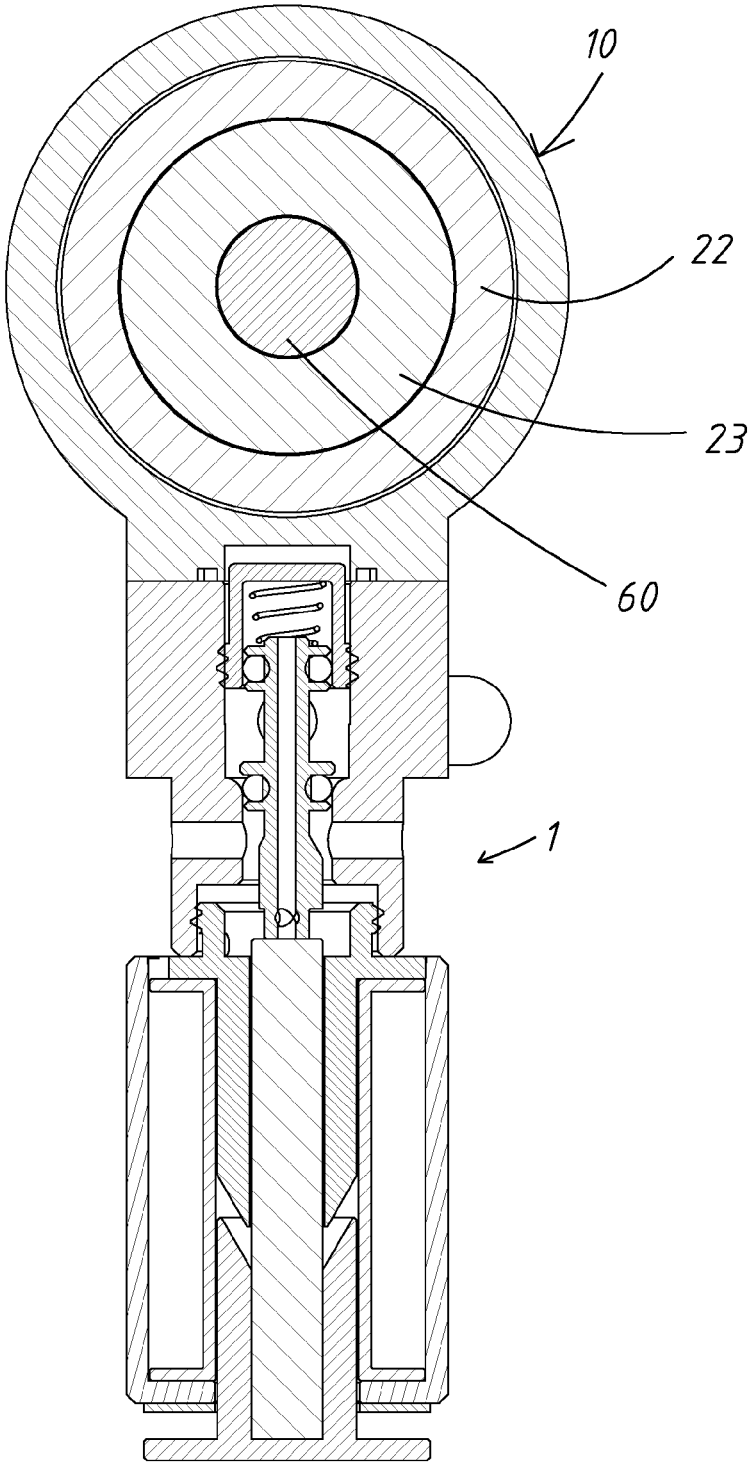
FIG. 5 is a sectional view taken along line 2-2 of FIG. 4.

Referring to FIGS. 1 to 9, a paint ball gun in accordance with the invention comprises the following components as discussed in detail below.

A shell 10 is cylindrical and comprises a forward muzzle 14, an intermediate passage 11 communicating with the muzzle 14, a ball inlet 12 on the top of the passage 11, a rear channel 13 communicating with the passage 11 and being rearward of the inlet 12, a gas inlet 15 on the bottom of the channel 13, a forward port 16 on the bottom of the channel 13 and being in front of the gas inlet 15, an intermediate port 17 on the bottom of the channel 13 and being rearward of the gas inlet 15, a rear port 18 on the bottom of the channel 13 and being rearward of the intermediate port 17, and a main line 19 having one end connected to the forward port 16 and the other end connected to the rear port 18. The main line 19 is also attached to a spring biased reciprocating member 1 which is served as pistol grip and can be activated by pressing a trigger (not shown).

A sleeve assembly 20 is disposed in the channel 13 and has a length substantially the same as that of the channel 13. The sleeve assembly 20 comprises a forward sleeve 21 and a rearward sleeve 22 threadedly secured together. The forward sleeve 21 has a forward end retained by an internal shoulder at a joining portion of the ball inlet 12 and the channel 13. The rearward sleeve 22 has a rear portion threadedly secured to an internally threaded rear end of the shell 10 and comprises a forward opening 29, an annular outer flange 24 adjacent the forward opening 29, a plurality of peripherally arranged inlet ports 25 rearward of the flange 24, an intermediate tunnel 26, a first port 27 on the tunnel 26, the first port 27 communicating with the rear port 18, and a second port 28 on the tunnel 26, the second port 28 being disposed in front of the first port 27 and communicating with the intermediate port 17.

A hollow, cylindrical plunger 40 comprises a forward opening 43. A first peripheral space 41 is formed between the plunger 40 and the forward sleeve 21 when the plunger 40 is slidably mounted in the forward sleeve 21. A retaining sleeve 30 is disposed at a forward portion of the rearward sleeve 22 and extends into the plunger 40. The retaining sleeve 30 comprises a forward flared channel 31 proximate the forward opening 43, a rear section 32, a tunnel 36 in the rear section 32 communicating with the channel 31, a plurality of peripherally arranged first ports 37 on the rear section 32, a plurality of peripherally arranged second ports 35 forwardly of the first ports 37, a plurality of peripherally arranged grooves 34 on a joining portion of the forward portion and the rearward portion on an outer surface of the retaining sleeve 30, an annular inclined shoulder 38 at a joining portion of the channel 31 and the tunnel 36, and an annular flange 39 on the outer surface, the flange 39 being rearward of the grooves 34 and adjacent thereto.

A cup-shaped sliding valve 50 is provided in the retaining sleeve 30 and has a forward end complimentarily engaged with the inclined shoulder 38 and a transverse passageway 51 communicating its hollow interior and the outer surface. A hollow member 33 is threadedly secured to an internally threaded rearward end of the retaining sleeve 30 and is disposed in the rearward sleeve 22. A cylindrical block 60 comprises a forward cavity 61 and a transverse passageway 62 communicating the cavity 61 and the outer surface. A hollow retaining member 23 has an outer surface partially threadedly secured to the internally threaded rear end of the rearward sleeve 22 and an inner surface partially threadedly secured to an externally threaded portion of an outer surface of the block 60.

Moreover, a plurality of O-rings (not numbered) are provided for sealing and leak proof purposes.

Figure 9:
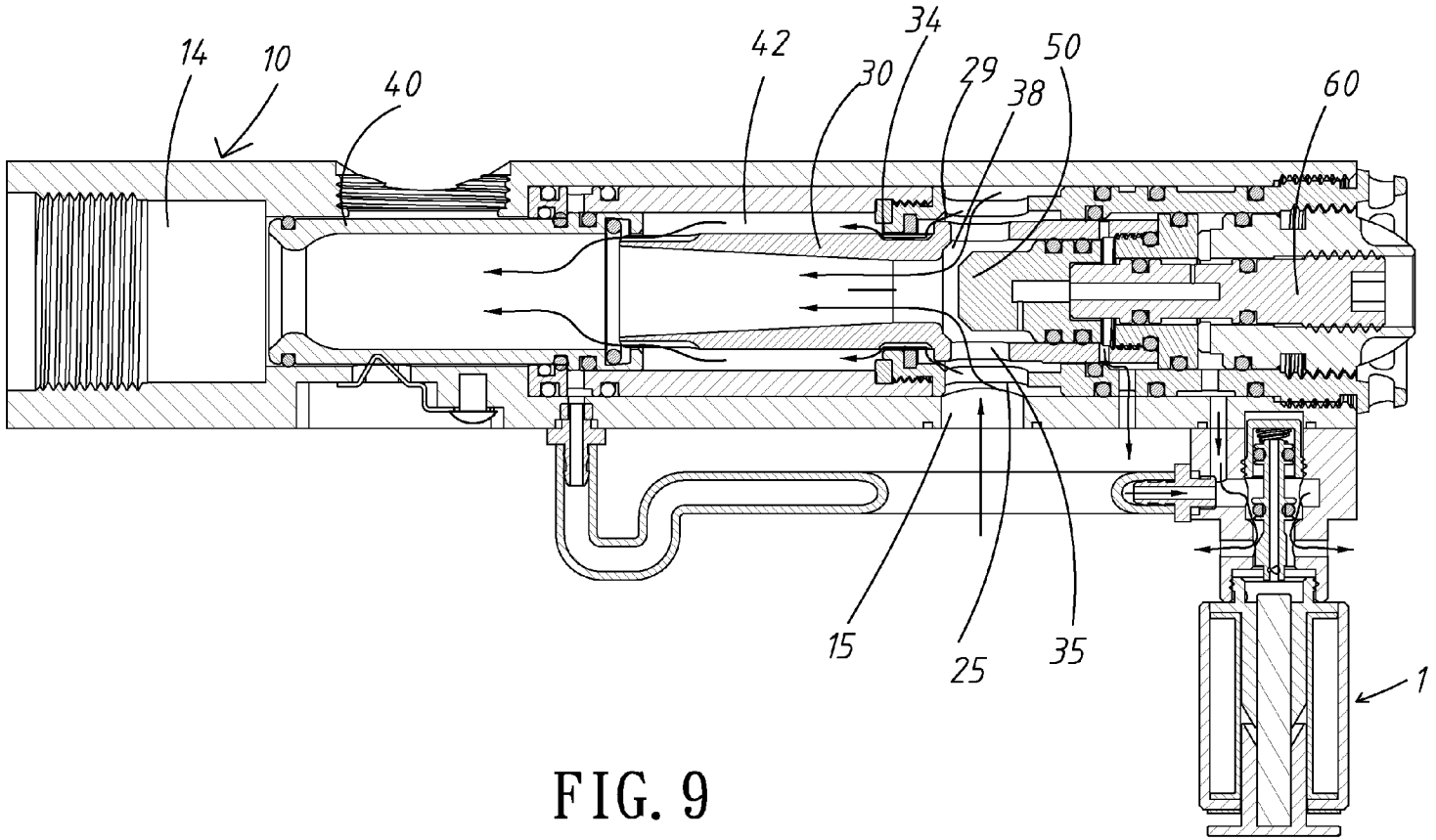

An operation of the invention will be described in detail below. As shown in FIG. 9, press the trigger to supply pressurized gas (e.g., air or $CO_2$) to the third ports 25 via the gas inlet 15 and the inlet ports 25. The pressurized gas forces the sliding valve 50 move backward. Thus, the shoulder 38 is open to allow a majority of the pressurized gas to flow into the channel 31 to push the plunger 40 forward. Also, the pressurized gas opens the forward opening 29 to move the retaining sleeve 30 rearward a small distance. And in turn, it allows the pressurized gas to push the plunger 40 forward so as to create and increase volume of a second peripheral space 42 between the retaining sleeve 30 and the forward sleeve 21. This in turn decreases the volume of the first peripheral space 41 to a minimum due to the forward movement of the plunger 40. As a result, a paint ball dropped into the passage 11 right below the inlet 12 is quickly pushed forward out of the muzzle 14 by the plunger 40, i.e., being fired. A portion of the pressurized gas is released to the air via the reciprocating member 1.

Figure 6:
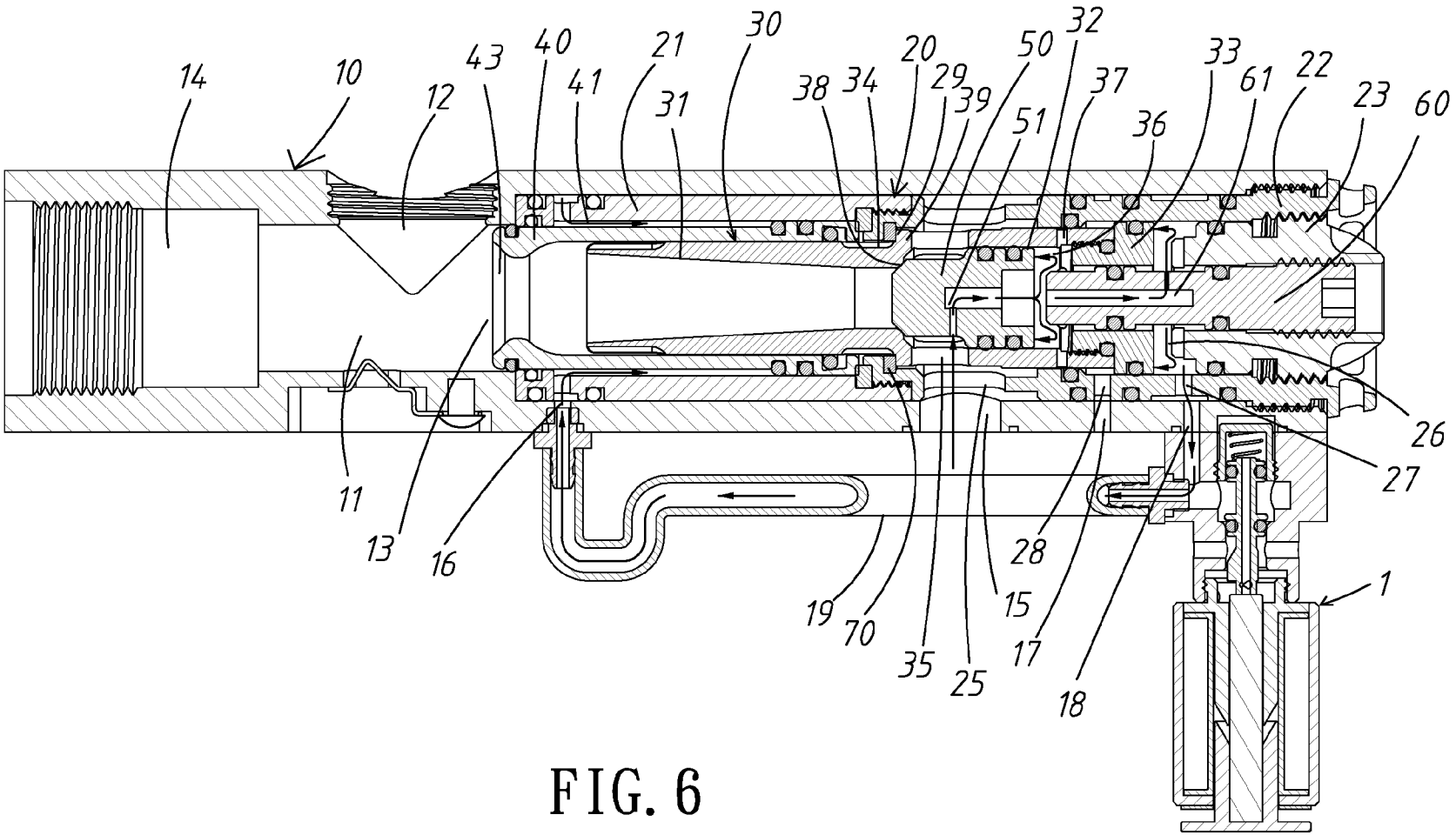
FIGS. 6, 7, 8, and 9 are views similar to FIG. 4 showing steps of firing a paint ball by using the paint ball gun of the invention.

As shown in FIG. 6, as a continuation of FIG. 9, the pressurized gas stops supplying to the third ports 25. But the pressurized gas enters the main line 19 and supplies to the first peripheral space 41 via the forward port 16. As such, the space of the first peripheral space 41 is increased (i.e., space of the second peripheral space 42 being decreased). As a result, the plunger 40 is pushed rearward to its inoperative position. Also, both the retaining sleeve 30 and the sliding valve 50 move rearward to close both the shoulder 38 and the forward opening 29. This is the end of the firing.

Figure 7:
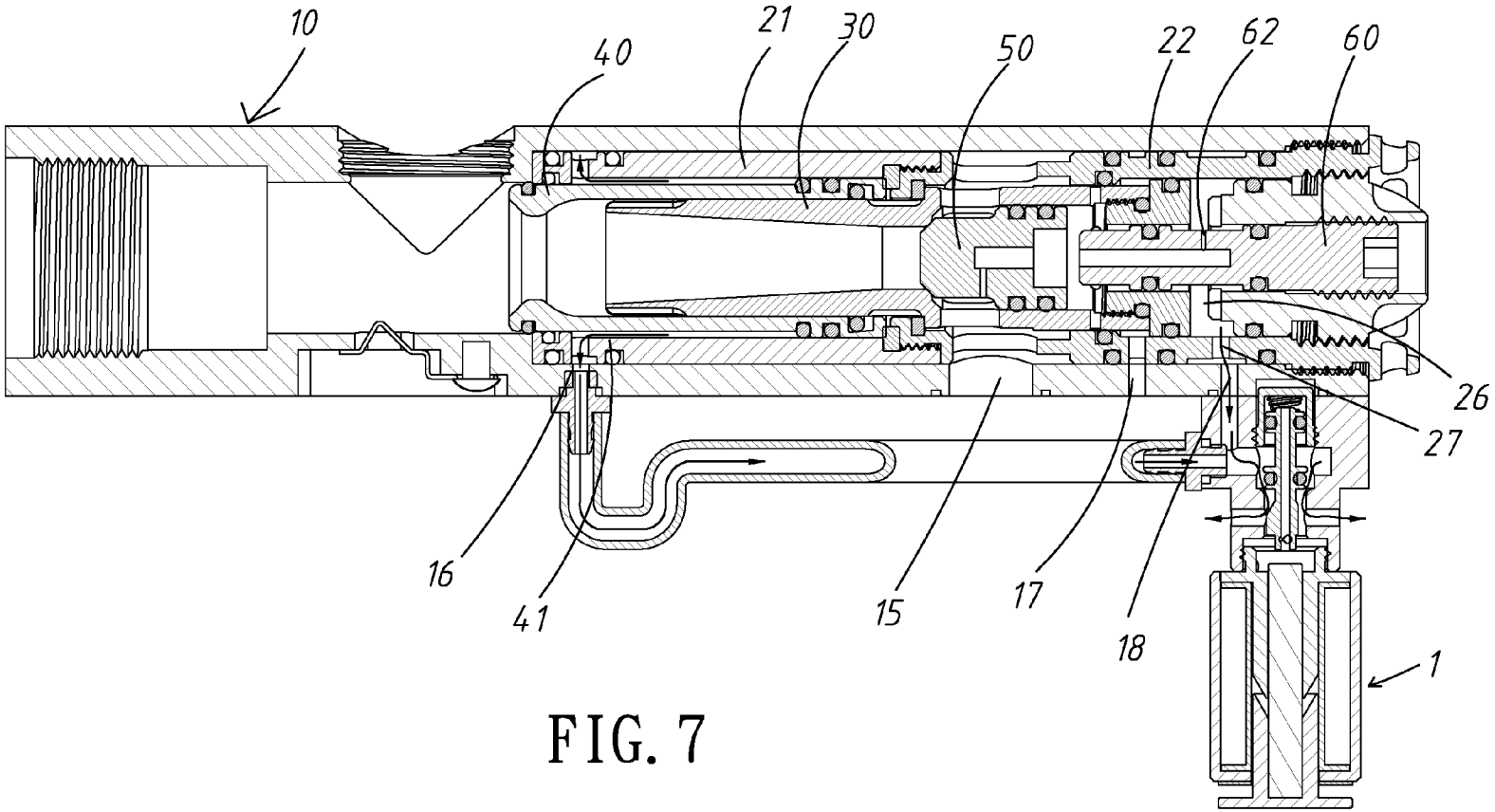

As shown in FIG. 7, as a continuation of FIG. 6, the pressurized gas in the first peripheral space 41 returns to the main line 19 via the forward port 16 after stopping the supply of the pressurized gas. The pressurized gas in the main line 19 exits to the atmosphere via the reciprocating member 1. This is the initial step of firing preparation.

Figure 8:
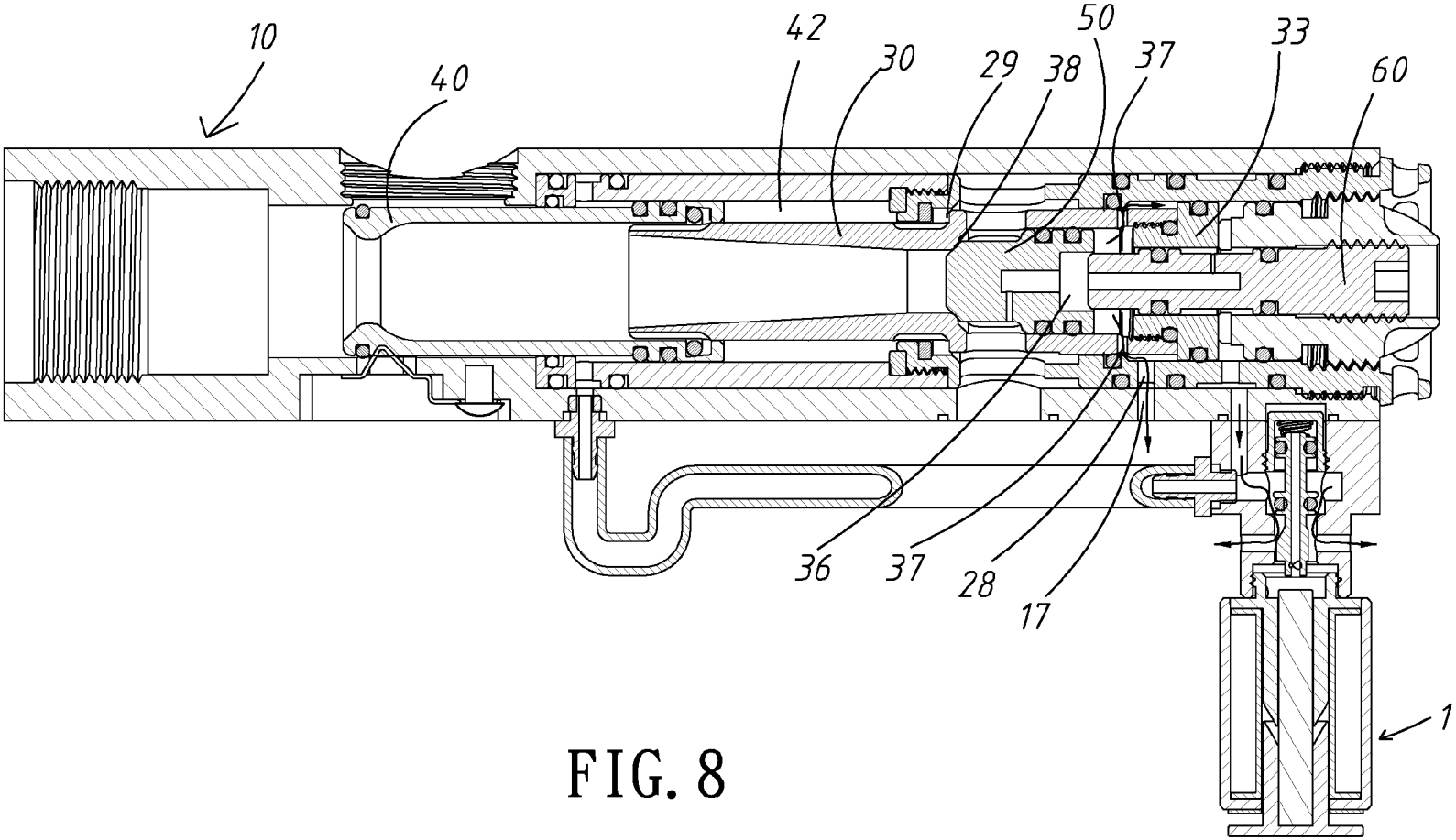

As shown in FIG. 8, as a continuation of FIG. 7, the remaining gas in the tunnel 36 exits to the atmosphere via the first ports 37, the second port 28 and the intermediate port 17. Also, a portion of the gas in the tunnel 36 exits to the atmosphere via the reciprocating member 1. This is the final step of the firing preparation.

While the invention has been described in terms of preferred embodiments, those skilled in the art will recognize that the invention can be practiced with modifications within the spirit and scope of the appended claims.

What is claimed is:

1. A device for controlling the firing of a paint ball gun comprising:

a shell (10) comprising a forward muzzle (14), an intermediate passage (11), a ball inlet (12) on the top of the passage (11), a rear channel (13), a gas inlet (15) on the bottom of the channel (13), a forward port (16) on the bottom of the channel (13) and being in front of the gas inlet (15), an intermediate port (17) on the bottom of the channel (13) and being rearward of the gas inlet (15), a rear port (18) on the bottom of the channel (13), and a main line (19) having one end connected to the forward port (16) and the other end connected to the rear port (18);

a reciprocating member (1) communicating with the main line (19);

a sleeve assembly (20) disposed in the channel (13) and comprising a forward sleeve (21) and a rearward sleeve (22) releasably secured together, the rearward sleeve (22) comprising a plurality of peripherally arranged inlet ports (25), a peripheral first port (27) communicating with the rear port (18), and a peripheral second port (28) communicating with the intermediate port (17);

a hollow, cylindrical plunger (40) slidably disposed in the forward sleeve (21) and comprising a first peripheral space (41) defined between the plunger (40) and the forward sleeve (21);

a slidable retaining sleeve (30) disposed at a forward portion of the rearward sleeve (22) and extending into the plunger (40), the slidable retaining sleeve (30) comprising a plurality of peripherally arranged rear third and fourth ports (35, 37), a plurality of peripherally arranged intermediate grooves (34) on an outer surface, an annular inclined shoulder (38) on an intermediate portion of an inner surface, and a hollow member (33) releasably fastened in the slidable retaining sleeve (30);

a cup-shaped sliding valve (50) disposed in the slidable retaining sleeve (30), the sliding valve (50) being complimentarily engaged with the inclined shoulder (38), the sliding valve (50) comprising a transverse passageway (51) communicating its hollow interior and an outer surface;

a cylindrical block (60) comprising a forward cavity (61) and a transverse passageway (62) communicating the cavity (61) and an outer surface; and a hollow retaining member (23) releasably secured to both the rearward sleeve (22) and the block (60) and sandwiched therebetween.

2. The device of claim 1, wherein the slidable retaining sleeve (30) further comprises a flared forward end (31).

* * * * *